US008375633B2

(12) United States Patent
Ikezumi et al.

(10) Patent No.: US 8,375,633 B2
(45) Date of Patent: Feb. 19, 2013

(54) VEHICULAR SLIDING DOOR STRUCTURE

(75) Inventors: Asato Ikezumi, Wako (JP); Masato Asakura, Wako (JP); Hiroshi Tokuyama, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 244 days.

(21) Appl. No.: 12/899,112

(22) Filed: Oct. 6, 2010

(65) Prior Publication Data

US 2011/0078954 A1 Apr. 7, 2011

(30) Foreign Application Priority Data

Oct. 7, 2009 (JP) ..... 2009-233708

(51) Int. Cl.
*E05F 15/02* (2006.01)

(52) U.S. Cl. ..... 49/27; 49/28; 49/360

(58) Field of Classification Search ..... 49/26, 27, 49/28, 360, 279, 280; 292/216, DIG. 23, 292/DIG. 46

See application file for complete search history.

(56) References Cited

U.S. PATENT DOCUMENTS

| | | | | |
|---|---|---|---|---|
| 4,304,071 | A * | 12/1981 | Obrecht | 49/26 |
| 4,887,390 | A * | 12/1989 | Boyko et al. | 49/214 |
| 6,125,583 | A * | 10/2000 | Murray et al. | 49/291 |
| 6,339,305 | B1 * | 1/2002 | Ishihara et al. | 318/445 |
| 6,390,516 | B1 * | 5/2002 | Kobayashi | 292/201 |
| 6,588,829 | B2 * | 7/2003 | Long et al. | 296/155 |
| 7,003,915 | B2 * | 2/2006 | Yokomori | 49/360 |
| 7,073,291 | B2 * | 7/2006 | Kawanobe et al. | 49/26 |
| 7,958,672 | B2 * | 6/2011 | Ishihara | 49/26 |
| 8,191,311 | B2 * | 6/2012 | Sakamaki et al. | 49/27 |
| 2007/0022819 | A1 * | 2/2007 | Takeuchi et al. | 73/756 |

FOREIGN PATENT DOCUMENTS

| | | | |
|---|---|---|---|
| JP | 08-260793 | | 10/1996 |
| JP | 08260793 | A * | 10/1996 |
| JP | 2000-136975 | | 5/2000 |
| JP | 2000136975 | A * | 5/2000 |
| JP | 2000-199375 | | 7/2000 |
| JP | 2000199375 | A * | 7/2000 |

* cited by examiner

*Primary Examiner* — Katherine Mitchell
*Assistant Examiner* — Abe Massad
(74) *Attorney, Agent, or Firm* — Rankin, Hill & Clark LLP

(57) ABSTRACT

A vehicular sliding door structure includes a sliding door having a closure portion configured to undergo abutting engagement with a mating portion of a vehicle body. The closure portion has an opening for allowing the entry of a striker therethrough into an internal space of the sliding door for locking engagement with a lock device. An anti-pinch sensor disposed on the closure portion has a sensor harness arranged to enter an internal space of the sliding door through the opening. A single cover member is provided on the closure portion so as to close the opening and cover a portion of the sensor harness. The cover member has a through-hole for the passage therethrough of the striker.

9 Claims, 8 Drawing Sheets

VEHICULAR SLIDING DOOR STRUCTURE

FIELD OF THE INVENTION

The present invention relates to a vehicular sliding door structure including a sliding door that is provided on the side of a vehicle body and opens by sliding horizontally in a longitudinal direction of the vehicle body.

BACKGROUND OF THE INVENTION

Various vehicular sliding door structures of the type concerned are known and used heretofore. According to one such known vehicular sliding door structure disclosed in Japanese Patent Laid-Open Publication (JP-A) No. 2000-199375, a sliding door can be electrically driven, and an anti-pinch sensor is provided on a front end surface of the sliding door for detecting an object in a potential pinch region between the sliding door and a mating portion of the vehicle body. The anti-pinch sensor is comprised of a touch sensor fitted on a longitudinal edge of one arm of an L-shaped support bracket attached to the front end surface of the sliding door and extending between an upper end and a lower end of the front end face of the sliding door. The front end surface of the sliding door has an opening formed therein so that a sensor harness of the anti-pinch sensor can be introduced into an internal space of the sliding door for electrical connection with a sliding door control unit.

The opening formed in the front end surface of the sliding door is not closed and may allow dust to enter the internal space of the sliding door, which might deteriorate the performance of the sliding door control unit disposed inside the sliding door. The conventional sliding door structure further includes a protecting cover attached to a lower end portion of the support bracket so as to cover an end portion of the sensor harness. The protecting cover, which is provided separately from the support bracket, is disadvantageous as it increases the production cost of the sliding door structure and deteriorates the appearance of the sliding door structure.

SUMMARY OF THE INVENTION

It is accordingly an object of the present invention to provide a vehicular sliding door structure which is capable of concealing a sensor harness without deteriorating the appearance of a sliding door, can be manufactured at a relative low cost, and is able to prevent dust from entering an internal space of the sliding door.

According to the present invention, there is provided a vehicular sliding door structure, comprising: a sliding door slidably mounted on a vehicle body for opening and closing an opening defined in the vehicle body, the sliding door having a closure portion configured to undergo abutting engagement with a mating portion of the vehicle body; a lock device disposed in the closure portion of the sliding door for locking the sliding door relative to the vehicle body; an anti-pinch sensor disposed on the closure portion of the sliding door for detecting an obstacle in a path of movement of the sliding door to thereby prevent the obstacle from being pinched between the sliding door and the vehicle body; and a striker provided on the mating portion of the vehicle body for undergoing locking engagement with the lock device. The closure portion of the sliding door has an opening for allowing the entry of the striker therethrough into an internal space of the sliding door for locking engagement with the lock device. The anti-pinch sensor has a sensor harness arranged to enter the internal space of the sliding door through the opening. A single cover member is provided on the closure portion of the sliding door so as to close the opening and cover a portion of the sensor harness, the cover member having a through-hole for the passage therethrough of the striker.

With this arrangement, since the sensor harness of the anti-pinch sensor is covered by the single cover member that is provided on the closure portion of the sliding door, the sliding door as a whole is attractive in appearance. Furthermore, since the cover member closes the opening formed in the closure portion of the sliding door, it is possible to preclude entry of dust into the internal space of the sliding door through the opening.

Preferably, the cover member has a recessed harness-accommodating groove for receiving therein the portion of the sensor harness wherein the harness-accommodating groove has one end facing the anti-pinch sensor and an opposite end connected to the opening of the closure portion of the sliding door, and the harness-accommodating groove slopes upward from the one end toward the opposite end thereof. Since the harness-accommodating groove has a rising slope as viewed from the anti-pinch sensor, water such as rain water adhering to the sensor harness does not run up the sensor harness portion accommodated in the harness-accommodating groove. It is therefore possible to prevent entry of water into the internal space of the sliding door through the opening of the closure portion of the sliding door.

It is preferable that the cover member includes a cover body for covering the opening of the closure portion, and a lip-like portion projecting from an end of the cover body and extending to the anti-pinch sensor, the lip-like portion being configured to extend along a surface configuration of the sliding door and cover the portion of the sensor harness. By virtue of the lip-like portion configured to cover the sensor harness portion, the sensor harness portion can readily and smoothly be accommodated in the harness-accommodating groove of the cover member.

Preferably, the lip-like portion of the cover member and the closure portion of the sliding door define therebetween a vertical space, the vertical space being open at a lower end thereof and closed at an upper end thereof by a horizontal top wall formed at an upper end of the lip-like portion of the cover member, the top wall of the lip-like portion being in close contact with the closure portion of the sliding door. The top wall of the lip-like portion closes the upper end of the vertical space and, hence, the sliding door as a whole is improved in appearance. The vertical space opens at its lower end can serve as a water drainage passage.

It is preferable that the cover member has a first orientation part for confirming a vertical alignment between the through-hole and the striker, and a second orientation part for confirming a lateral alignment between the through-hole and the striker. With the orientation parts thus provided, it is readily possible to adjust the assembling accuracy of the sliding door and the vehicle body.

Preferably, the first orientation part extends along a peripheral edge of the through-hole and is thin and elastically deformable. The elastically deformable first orientation part can be located as close to the striker as possible.

It is preferable that the cover member has an abutment rib projecting toward the striker for undergoing abutting engagement with a base portion of the striker. By thus providing the abutment rib, it is possible to keep the engagement between the striker and the lock device in a stable condition.

Preferably, the cover member has a single-piece molded structure composed of a first piece of rigid plastic and a second piece of flexible plastic that are integrally molded with each other. A part of the harness-accommodating groove including said one end thereof is formed in the second piece, and the remaining part of the harness-accommodating groove is formed in the first piece. By thus forming the end portion of the harness-accommodating groove by the flexible plastic, it is possible to protect the sensor harness portion from damage. The first piece has a first color and the second piece has a second color which is different from the first color of the first piece. By thus differentiating the color of the first and second pieces, it is readily possible to visually confirm the physical characteristics of the two pieces of the cover member.

BRIEF DESCRIPTION OF THE DRAWINGS

One preferred structural embodiment of the present invention will be described in detail below, by way of example only, with reference to the accompanying drawings, in which.

DETAILED DESCRIPTION OF THE PREFERRED EMBODIMENT

Figure 1:
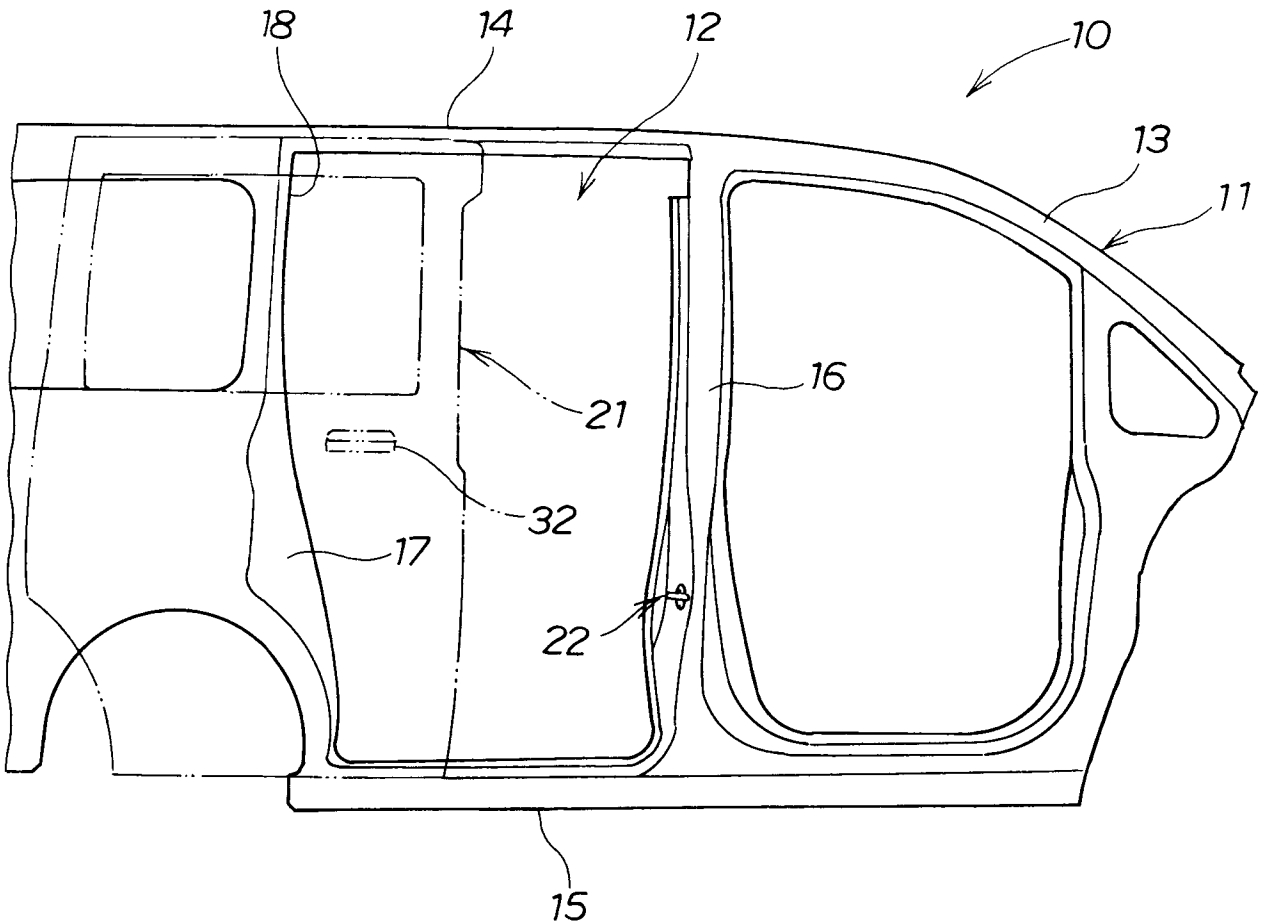
FIG. 1 is a fragmentary side view of a vehicle in which a sliding door structure according to the present invention is incorporated.

As shown in FIG. 1, a vehicle 10 includes a vehicle body 11 having a front pillar 13, a roof rail 14 extending from an upper end of the front pillar 13 in a rearward direction of the vehicle body 11, a side sill 15 disposed at the bottom of the vehicle body 11 and extending in a longitudinal direction of the vehicle body 11, a center pillar 16 extending vertically between a longitudinal intermediate portion of the roof rail 14 and a longitudinal intermediate portion of the side sill 15, a rear pillar 17 extending vertically between a rear end portion of the roof rail 14 and a rear end portion of the side sill 15, a door opening 18 defined jointly by the roof rail 14, the side sill 15, the center pillar 16 and the rear rail 17, a sliding door 21 slidably mounted on a lateral side of the vehicle body 11 for opening and closing the door opening 18, and a drive unit (not shown) disposed on a side surface of a rear portion of the vehicle body 11 for driving the sliding door 21 to perform sliding movement to open and close the door opening 18.

Figure 2:
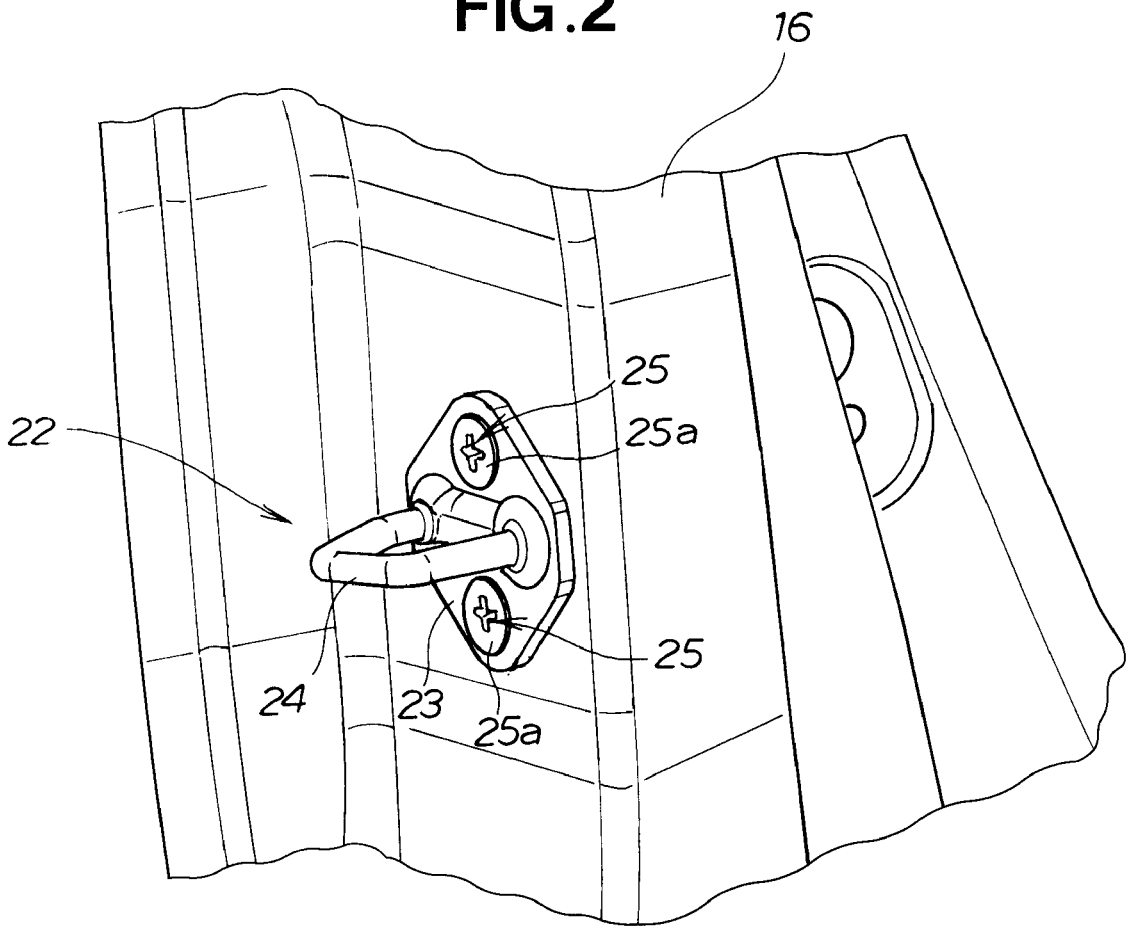
FIG. 2 is a fragmentary perspective view of a center pillar constituting part of the sliding door structure.

The center pillar 16 is provided with a striker 22 with which the sliding door 21 is to be locked. As shown in FIG. 2, the striker 22 includes a plate-like base portion 23 attached by a pair of set screws 25 to the center pillar 16, and a substantially U-shaped striker body 24 projecting from the base portion 23. The U-shaped striker body 24 has an open end connected to the base portion 23 so that the striker 22 has a closed loop-like configuration.

The sliding door 21 is constructed such that when the non-illustrated drive unit is in an energized or "ON" state, the sliding door 21 can be automatically opened and closed, and when the drive unit is in a de-energized or "OFF" state, the sliding door can be manually opened and closed. The sliding door 21 has a door handle 32 for manipulation by a human operator including a vehicle occupant.

Figure 3:
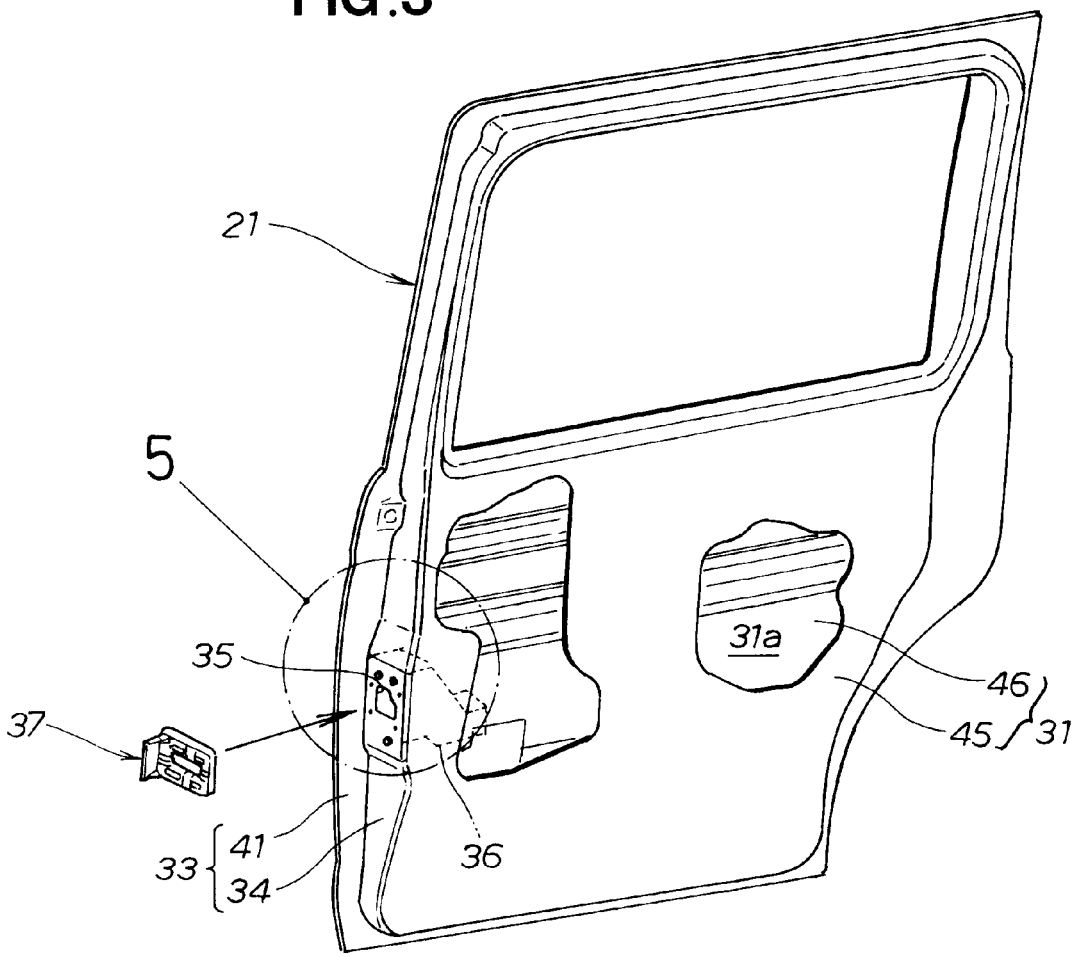
FIG. 3 is a perspective view, with parts cutaway for clarity, of a door body shown with a cover member removed from an opening of the door body.
Figure 4:
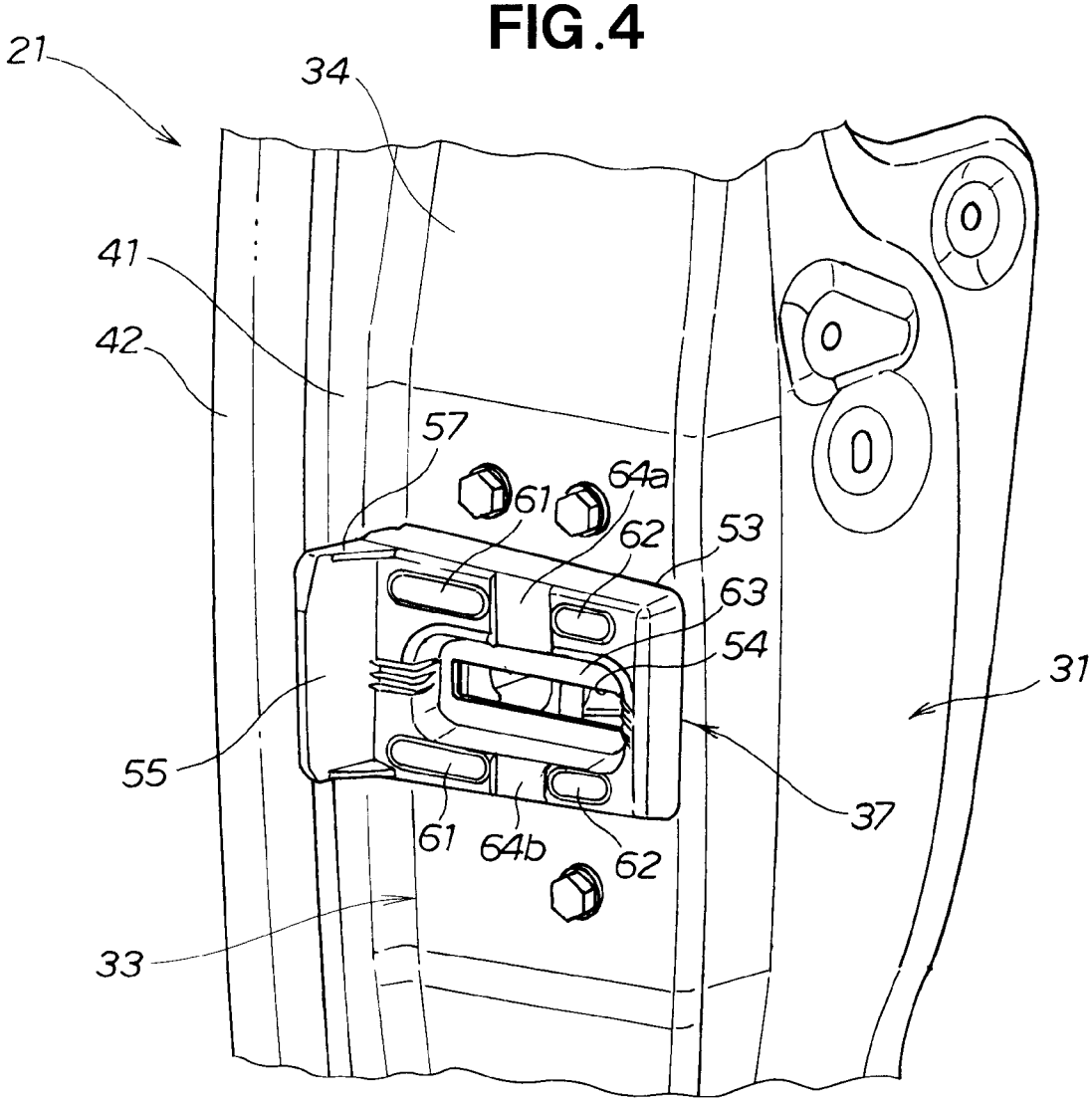
FIG. 4 is an enlarged perspective view of a portion of the door body shown with the cover member attached to close the opening of the door body.
Figure 5:
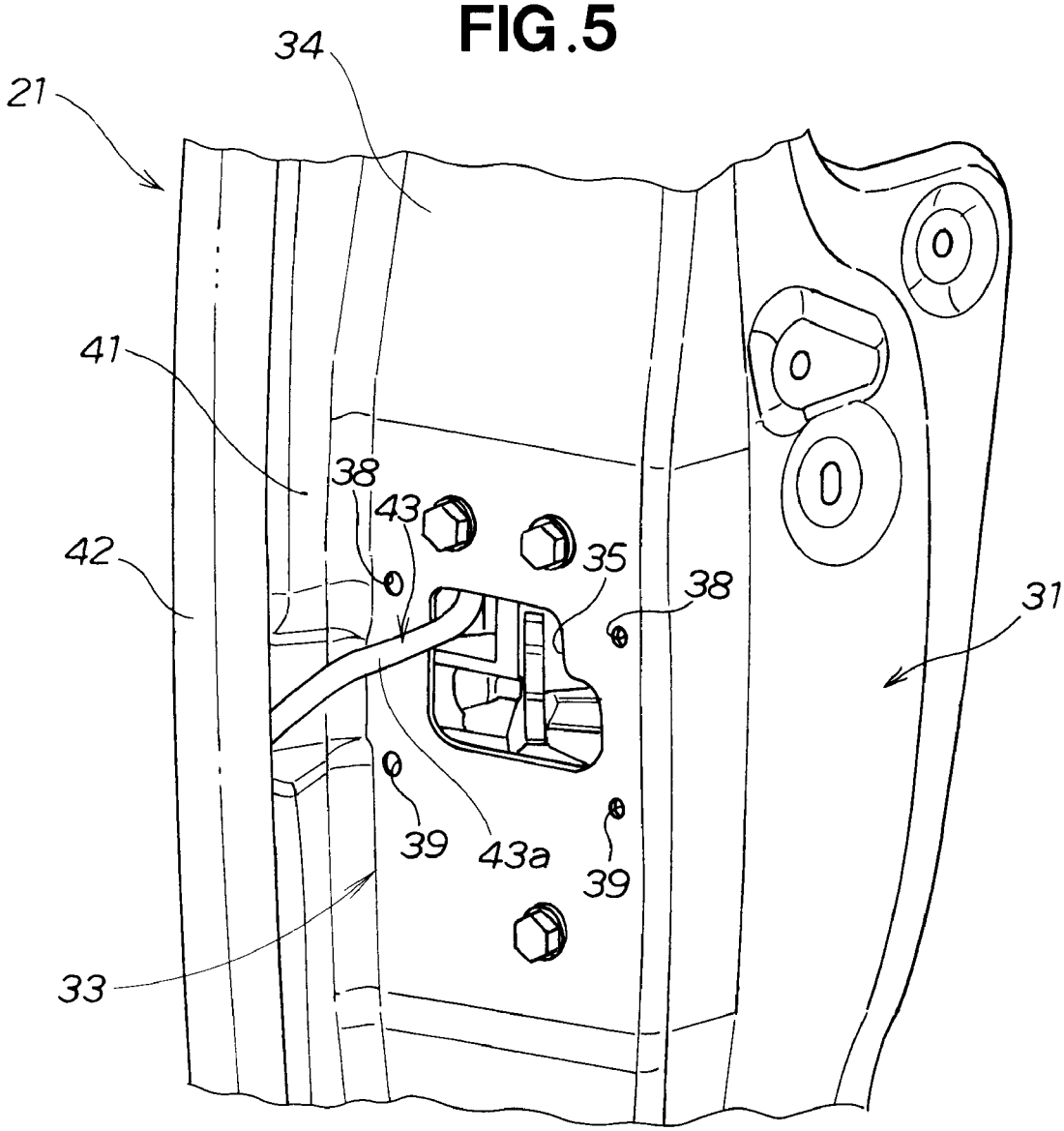
FIG. 5 is a view similar to FIG. 4, but showing the door body portion with the cover member removed therefrom.

As shown in FIGS. 3-5, the sliding door 21 includes a door body 31 having a closure portion 33 configured to undergo abutting engagement with a mating portion (center pillar) 16 of the vehicle body 11. The closure portion 33 includes a front end surface 34 of the door body 31 and that part of a peripheral flange 41 of the door body 31 which extends along the front end surface 34 of the door body 31. The closure portion 33 has an opening 35 formed in the front end surface 34 of the door body 31 for allowing entry of the striker 22 into a hollow internal space 31*a* (FIG. 3) of the sliding door body 31 through the opening 35. The sliding door 21 also includes a lock device 36 for locking the sliding door 21 in position against movement relative to the vehicle body 11. The lock device 36 is disposed inside the door body 31 and located adjacent to the opening 35. A single cover member 37 is attached to the closure portion 33 so as to close the opening 35. The cover member 37 has a through-hole 54 (FIG. 4) for the passage therethrough of the striker 22 provided on the center pillar 16 of the vehicle body 11. An anti-pinch sensor 42 is provided for detecting an obstructing object or obstacle in a path of movement of the sliding door 21 so as to prevent the obstacle from being pinched between the sliding door 21 and the center pillar 16 of the vehicle body 11. The anti-pinch sensor 42 is comprised of a touch sensor disposed on the front end surface 34 of the closure portion 33 and extending along the peripheral flange 41 between an upper end and a lower end of the front end surface 34. The anti-pinch sensor 42 has a sensor harness 43 (FIG. 5) arranged to enter the 31*a* (FIG. 3) of the sliding door 31 through the opening 35 for electrical connection with the sliding door control unit disposed inside the sliding door body 31.

As shown in FIG. 5, the opening 35 has a generally rectangular shape having a lower right corner extended in an interior side of the door body 31. For attachment to the cover member 37, the closure portion 33 has a pair of first attachment holes 38 and 38 formed in the front end surface 34 of the door body 31 at positions located near upper left and right corners of the opening 35, and a pair of second attachment holes 39 and 39 formed in the front end surface 34 of the door body 31 at positions located near lower left and right corners of the opening 35.

Referring back to FIG. 3, the door body 31 includes an inner panel 45 facing a passenger compartment 12 (FIG. 1) of the vehicle 10, and an outer panel 46 forming an exterior surface of the vehicle body 11. The inner panel 45 and the outer panel 46 are assembled together so that the hollow internal space 31*a* is formed in the door body 31 for installation of various devices including the lock device 36, and the sliding door control unit (not shown). The peripheral flange 41 of the door body 31 is formed by an outer peripheral portion of the outer panel 45, and that part of the peripheral flange 41 which extends along the front end surface 34 of the door body 31 projects from the front end surface 34 in a forward direction of the vehicle body 11 (FIG. 1). The anti-pinch sensor 42 is partially fitted with the peripheral flange 41.

The door handle 32 shown in FIG. 1 is configured to unlock the door body 31 from the vehicle body 11 when it is pulled outwardly from the vehicle body 11 while the drive unit (not shown) for the sliding door 21 is in the de-energized or "OFF"

state. Now, the door body 31 can be opened manually by sliding it horizontally in the rearward direction of the vehicle body 11 while the door handle 32 is gripped by the human operator.

The anti-pinch sensor 42 is provided for detecting an obstacle in the path of movement of the sliding door 21 to thereby prevent the obstacle from being pinched between the sliding door 21 and the center pillar 16 of the vehicle body 11 during automatic closing operation of the sliding door 21 performed while the drive unit (not shown) is in the energized or "ON" state. When the anti-pinch sensor 42 detects such an obstacle, the direction of movement of the sliding door 21 is forcibly reversed. The anti-pinch sensor 42 is composed of a touch sensor as described above and has a structure known per se, which generally includes a pair of electrodes of conductive rubber disposed side by side with a predetermined space defined therebetween and covered with a non-conductive elastic material such as rubber or soft synthetic resin, and a pair of lead wires connected at one end to the electrodes, respectively. The lead wires constitute the sensor harness 43.

As shown in FIGS. 6-11, the cover member 37 has a single-piece molded structure formed by double-molding techniques and is composed of an inner piece 51 of rigid plastic and an outer piece 52 of flexible plastic that are integrally molded with each other in such a manner that the outer piece 52 covers a front surface, an inner peripheral surface and an outer peripheral surfaces of the inner piece 51. The inner piece 51 has a color which is different from a color of the outer piece 52. By thus differentiating the color of the inner and outer pieces 51, 52, it is readily possible to visually confirm the physical characteristics of the two pieces 51, 52.

The cover member 37 includes a cover body 53 of substantially rectangular plate-like configuration that covers the opening 35 of the door body 31 (FIG. 5) of the sliding door 21, a through-hole 54 formed in a central portion thereof for the passage therethrough of the striker 22, an inclined lip-like portion 55 projecting forwardly and outwardly from an exterior side (left side in FIG. 6) of the cover body 53 until it reaches the anti-pinch sensor 42 (FIG. 5) so as to cover a part 43*a* (FIG. 5) of the sensor harness 43 extending between the anti-pinch sensor 42 and the opening 35 (FIG. 5) of the closure portion 33, and a recessed harness-accommodating groove 56 (FIG. 7) formed in a rear surface of the cover body 53 and extending along a peripheral portion of the through-hole 54 located adjacent to a base portion the lip-like portion 55 for receiving the sensor harness portion 43*a*. As shown in FIG. 7, the harness-accommodating grove 56 has one end 56*a* opening to a space 59 formed behind the inclined lip-like portion 55. The space 59 extends in a vertical direction and defined between the closure portion 33 of the sliding door 21 and the inclined lip-like portion 55 of the cover member 37. The vertical space 59 has an upper end closed by a horizontal top wall 57 formed at an upper end of the lip-like portion 55. The top wall 57 is in close contact with an inner surface of the peripheral flange 41 of the sliding door body 31, as shown in FIG. 4. The lower end of the vertical space 59 is open so that the space 59 can serve as a water drainage passage. The vertical space 59 has a width W which corresponds to a projecting length of the lip-like portion 55 with respect to the rectangular cover body 53. The through-hole 54 is an elongated through-hole having a major axis extending horizontally along a longitudinal axis of the rectangular cover body 53.

Figure 6:
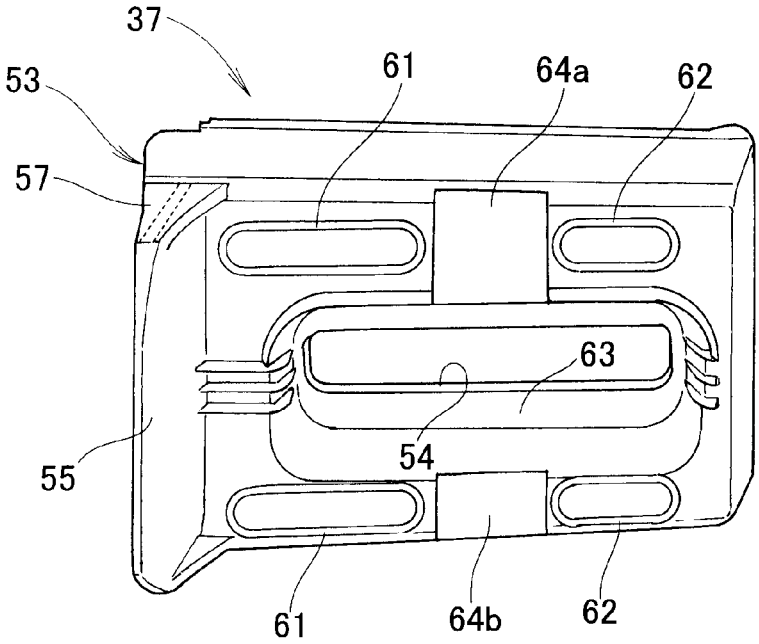
FIG. 6 is a front perspective view of the cover shown in FIG. 3.
Figure 7:
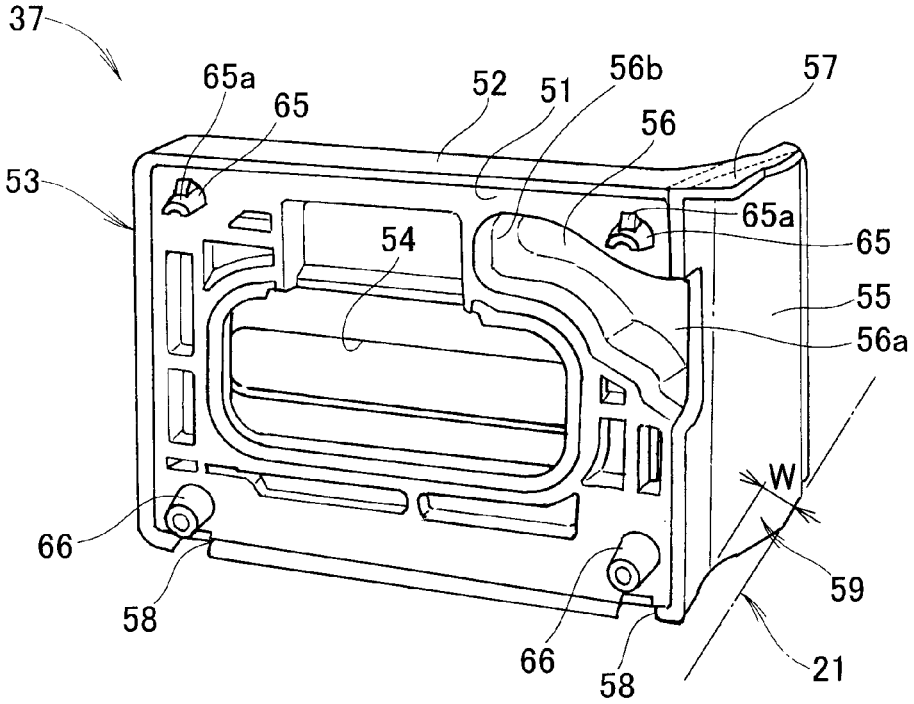
FIG. 7 is a rear perspective view of the cover.
Figure 9:
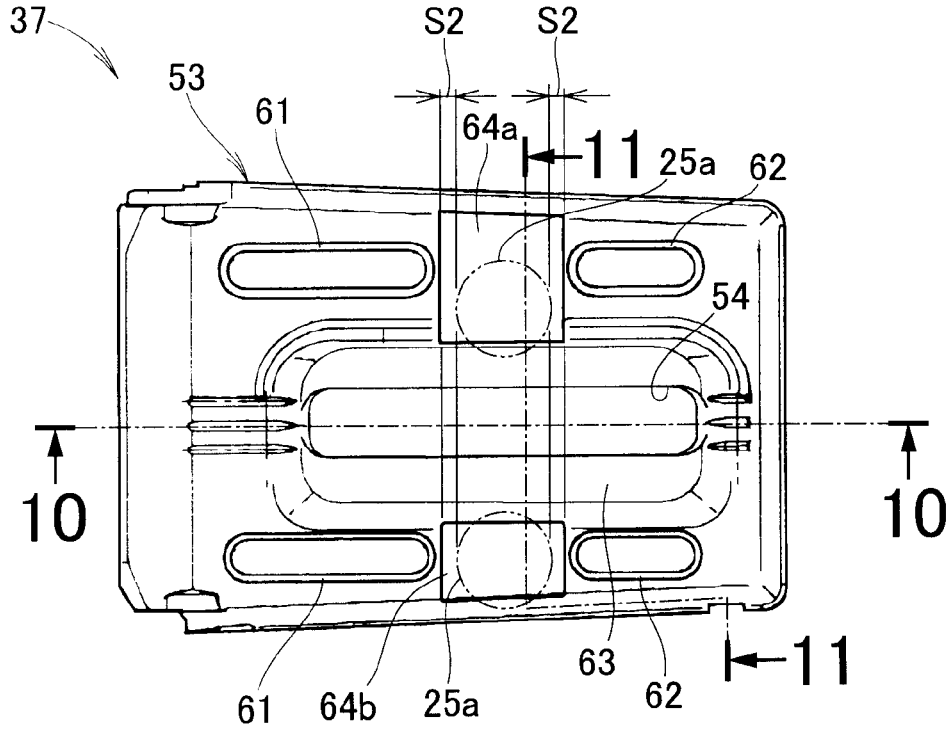
FIG. 9 is a front view of the cover.
Figure 10:
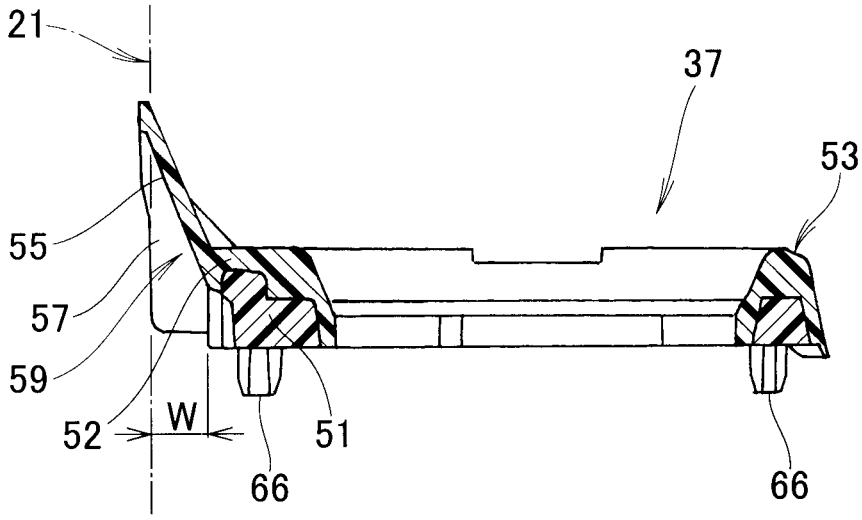
FIG. 10 is a cross-sectional view taken along line 10-10 of FIG. 9.
Figure 11:
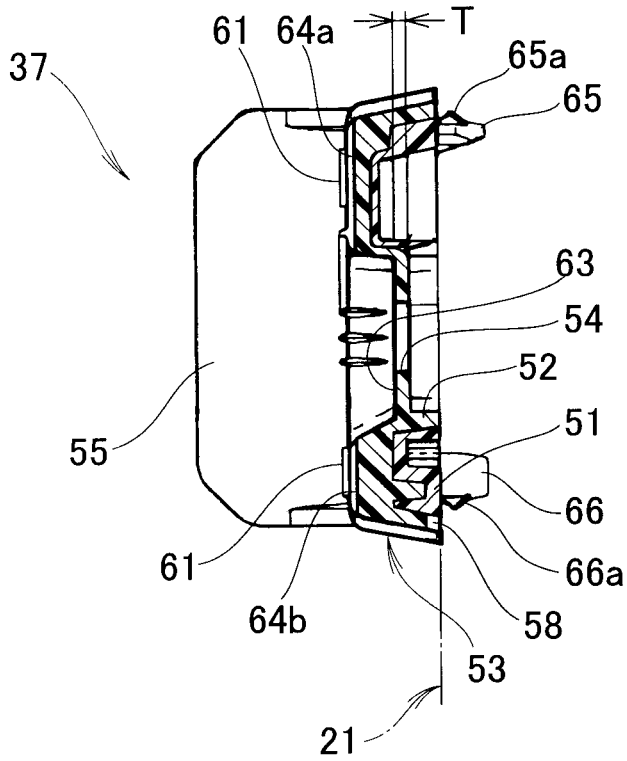
FIG. 11 is a cross-sectional view taken along the line 11-11 of FIG. 9.

As shown in FIGS. 6, 9 and 11, the cover member 37 has, on its front side, a pair of parallel spaced horizontally extending first abutment ribs 61 and 61 disposed respectively on upper and lower sides of the elongated through-hole 54 along one end portion (left end portion in FIGS. 6 and 9) of the elongated through-hole 54 for undergoing abutting engagement with the base portion 23 of the striker 22, a pair of parallel spaced horizontally extending second abutment ribs 62 and 62 disposed respectively on upper and lower sides of the elongated through-hole 54 along the other end portion (right end portion in FIGS. 6 and 9) of the elongated through-hole 54, a first orientation part 63 formed to extend along a peripheral edge of the elongated through-hole 54 for assisting visual confirmation of a vertical alignment between the through-hole 54 and the striker 22, and a pair of vertically aligned second orientation parts 64*a* and 64*b* disposed on an outer side of the first orientation part 63 for assisting visual confirmation of a lateral alignment between the cover member 37 and the striker 22.

As shown in FIGS. 7, 8, 10 and 11, on the back side thereof, the cover member 37 has a pair of first attachment projections 65, 65 disposed adjacent to upper corners of the rectangular cover body 53 and removably engageable with the first attachment holes 38 (FIG. 5) of the door body 21 for attaching the cover member 37 to the door body 21, a pair of second attachment projections 66, 66 disposed adjacent to lower corner of the rectangular cover body 53 and removably engageable with the second attachment holes 39 (FIG. 5) of the door body 21 for attaching the cover member 37 to the door body 53, and a pair of cutout recesses 58 formed in a lower edge of the cover body 53 for receiving the tip of a tool, such as a flathead screwdriver (not shown) when the cover member 37 is to be removed from the door body 21.

The first attachment projections 65 are in the shape of a slightly tapered semicircular hollow column or cylinder having a locking prong 65*a* (FIGS. 7, 8 and 11) projecting from an outer peripheral surface thereof in a vertically upward direction of the cover member 37. The locking prong 65*a* is lockingly engaged with a peripheral edge of a mating one of the first attachment holes 38 (FIG. 5) when the associated first engagement projection 65 is forced into the mating first attachment hole 38. On the other hand, the second attachment projections 66 are in the shape of a slightly tapered hollow cylinder having a locking prong 66*a* (FIGS. 8 and 11) projecting from an outer peripheral surface thereof in a vertical downward direction of the cover member 37. The locking prong 66*a* is lockingly engaged with a peripheral edge of a mating one of the second attachment holes 39 (FIG. 5) when the associated second engagement projection 66 is forced into the mating second engagement hole 39. The cutout recesses 58 are vertically aligned with the locking prongs 66*a* of the respective second attaching projections 66 for a purpose described later.

When the cover member 37 is to be attached to the door body 31, the cover member 37 is first placed on the front end surface 34 of the door body 31 in such a manner that respective ones of the first and second attachment projections 65, 66 are aligned with corresponding ones of the first and second attachment holes 38, 39 of the door body 31, and then the cover member 37 is forced toward the front end surface 34 of the door body 31 so that the attachment projections 65, 66 are inserted into the corresponding attachment holes 38, 39. Advancing movement of the attachment projections 65, 66 causes respective ones of the locking prongs 65*a*, 66*a* to come into snap-fitting engagement with peripheral edges of the corresponding attachment holes 38, 39. The cover member 37 is thus attached to the door body 31.

When the cover member 37 is to be detached from the door body 31, the tip of a suitable tool, such as a flathead screwdriver (not shown) is inserted in each of the cutout recesses 58 until it reaches the locking prong 66*a* of a corresponding one of the attachment projections 66. The tool is then manipulated to release the snap-fitting engagement between the locking prong 66*a* of the attachment projection 66 and the peripheral edge of the corresponding attachment hole 39 by using leverage. The cover member 37 can thus be removed from the door body 31.

As described above, the outer piece 52 of the cover member 37 is formed by a flexible plastic. This means that the central portion of the cover member 37 defining the through-hole 54, the lip-like portion 55, the top wall 57, the first and second abutment ribs 61 and 62, the first orientation part 63, and the second orientation parts 64*a*, 64*b* are formed by the flexible plastic as they constitute structural parts of the outer piece 52.

The inner piece 51 of the cover member 37 is formed by a rigid plastic. This means that the first and second attachment projections 65, 66 that form structural parts of the inner piece 51 are formed by rigid plastic. That part of the cover member 37 which defines the harness-accommodating groove 56 is essentially formed by rigid plastic, however, only a portion of that part of the cover member 37 which defines the end 56*a* of the harness-accommodating groove 56 is formed by flexible plastic because the end 56*a* is formed in the lip-like portion 55. By thus forming the end 56*a* of the harness-accommodating groove 56, it is possible to protect the harness 43 from damage.

Figure 8:
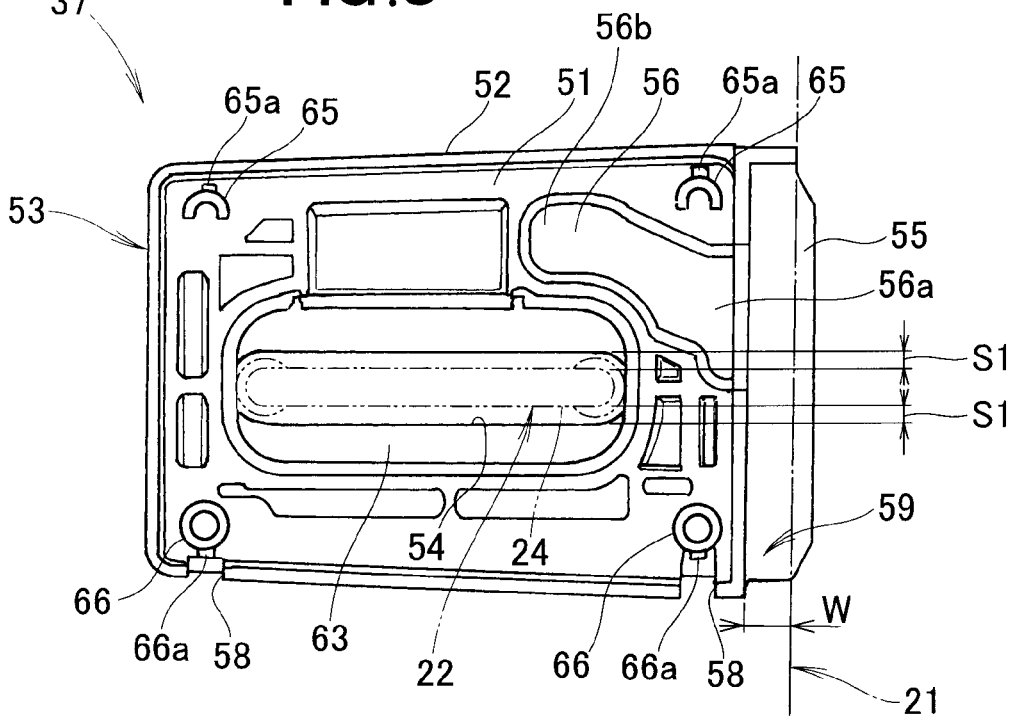
FIG. 8 is a rear view of the cover.

As shown in FIG. 11, the central portion of the cover member 37, which includes the through-hole 54 and the first orientation part 63, is reduced in thickness. The first orientation part 63 extends along the peripheral edge of the through-hole 54 has a thickness T much smaller than a thickness of the cover body 53 of the cover member 37. The first orientation part 63 is thin and elastically deformable as it constitutes a part of the outer piece 52 formed by flexible plastic. As shown in FIG. 8, the first orientation part 63 is used to confirm a vertical alignment between the striker 22 and the cover member 37 through visual observation of a space S1 formed in a vertical direction between the striker 22 and the cover member 37 when the striker 22 is received in the through-hole 54. By thus confirming the vertical alignment between the striker 22 and the cover member 37, it is readily possible to confirm whether the sliding door 21 (to which the cover member 37 is attached) is in vertical alignment with the vehicle body 11 (on which the striker 22 is mounted). If the visual observation indicates that the sliding door 21 and the vehicle body 11 are out of vertical alignment with each other, an adequate adjustment will be done to correct the vertical position of the sliding door 21 relative to the vehicle body 11.

As shown in FIG. 9, the second orientation parts 64*a*, 64*b* are formed by rectangular recessed portions formed in a front surface of the cover body 53. The second orientation parts 64*a*, 64*b* are used to confirm a lateral alignment between the striker 22 and the cover member 37 through visual observation of a space S2 formed in a lateral direction (widthwise direction of the vehicle body 11) between heads 25*a*, 25*a* of the set screws 25, 25 of the striker 22 and the recessed second orientation parts 64*a*, 64*b* of the cover member 37 when the striker 22 is received in the through-hole 54. By thus confirming the lateral alignment between the heads striker 22 and the cover member 37, it is readily possible to confirm whether the sliding door 21 (to which the cover member 37 is attached) is in alignment with the vehicle body 11 (on which the striker 22 is mounted) in a lateral or widthwise direction of the vehicle body 11. If the visual observation indicates that the sliding door 21 and the vehicle body 11 are out of lateral alignment with each other, an adequate adjustment will be done to correct the lateral position of the sliding door 21 relative to the vehicle body 11.

The harness-accommodating groove 56 is configured to extend obliquely upward from the anti-pinch sensor 42 (FIG. 5) toward the opening 35 of the closure portion 33 of the sliding door 21. Stated more specifically, as shown in FIG. 7, the harness-accommodating groove 56 has one end 56*a* facing the anti-pinch sensor 42 (FIG. 5) and an opposite end 56*b* connected with opening 35 (FIG. 5) of the closure portion 33 of the sliding door 21. The harness-accommodating groove 56 slopes upward from the one end 56*a* toward the opposite end 56*b* thereof. By thus forming the harness-accommodating groove 56, water such as rainwater adhering to the sensor harness 43 is no longer possible to run up the sensor harness portion 43*a* accommodated in the harness-accommodating groove 56 of the cover member 37. It is therefore possible to prevent entry of water into the internal space 31*a* of the sliding door body 31 through the opening 35 of the closure portion 33 of the sliding door 21.

The lip-like portion 55 of the cover member 37 is configured to extend along a surface configuration of the sliding door body 31 and cover the portion 43*a* of the sensor harness 43. More particularly, the lip-like portion 55 is configured to extend along the peripheral flange 41 of the sliding door body 31 that projects from the closure portion 33 in a forward direction of the vehicle body 11. With the lip-like portion 55 thus configured, the sensor harness portion 43*a* can readily and smoothly be accommodated in the harness-accommodating groove 56 of the cover member 37.

As thus far described, a vehicular sliding door structure according to the present invention comprises: a sliding door 21 slidably mounted on a vehicle body 11 for opening and closing an opening 18 defined in the vehicle body 11, the sliding door 21 having a closure portion 33 configured to undergo abutting engagement with a mating portion 16 of the vehicle body 11; a lock device 31 disposed in the closure portion 33 of the sliding door 21 for locking the sliding door 21 relative to the vehicle body 11; an anti-pinch sensor 42 disposed on the closure portion 33 of the sliding door 21 for detecting an obstacle in a path of movement of the sliding door 21 to thereby prevent the obstacle from being pinched between the sliding door 21 and the vehicle body 11; and a striker 22 provided on the mating portion 16 of the vehicle body 11 for undergoing locking engagement with the lock device 36. The closure portion 33 of the sliding door 21 has an opening 35 for allowing the entry of the striker 22 therethrough into an internal space 31*a* of the sliding door 21 for locking engagement with the lock device 36. The anti-pinch sensor 42 has a sensor harness 43 arranged to enter the internal space 31*a* of the sliding door 21 through the opening 35. A single cover member 37 is provided on the closure portion 33 of the sliding door 21 so as to close the opening 35 and cover a portion 43*a* of the sensor harness 43, the cover member 37 having a through-hole 54 for the passage therethrough of the striker 22.

With the vehicular sliding door structure thus arrangement, since the sensor harness 43 of the anti-pinch sensor 42 is covered by the single cover member 37 that is provided on the closure portion 33 of the sliding door 21, the sliding door 21 as a whole is attractive in appearance. Furthermore, since the cover member 37 closes the opening 35 formed in the closure portion 33 of the sliding door 21, it is possible to preclude entry of dust into the internal space 31*a* of the sliding door 21 through the opening 35.

The cover member 37 has a recessed harness-accommodating groove 56 for receiving therein the portion 43*a* of the sensor harness 43. The harness-accommodating groove 56 has one end facing the anti-pinch sensor 42 and an opposite end connected to the opening 35 of the closure portion 33 of the sliding door 21. The harness-accommodating groove 56 slopes upward from the one end toward the opposite end thereof. Since the harness-accommodating groove 56 has a rising slope as viewed from the anti-pinch sensor 42, water such as rain water adhering to the sensor harness is no longer possible to run up the sensor harness portion 43*a* accommodated in the harness-accommodating groove 56 having a rising slope. It is therefore possible to prevent entry of water into the internal space 31*a* of the sliding door 21 through the opening 35 of the closure portion 33 of the sliding door 21.

The cover member 37 includes a cover body 53 for covering the opening 35 of the closure portion 33, and a lip-like portion 55 projecting from an end of the cover body 53 and extending to the anti-pinch sensor 42. The lip-like portion 55 is configured to extend along a surface configuration of the sliding door 21 and to cover the sensor harness portion 43*a*. By virtue of the lip-like portion 55 configured to cover the sensor harness portion 43*a*, the sensor harness portion 43*a* can readily and smoothly be accommodated in the harness-accommodating groove 56 of the cover member 37.

The lip-like portion 55 of the cover member 33 and the closure portion 33 of the sliding door 21 define therebetween a vertical space 59. The vertical space 59 is open at a lower end thereof and closed at an upper end thereof by a horizontal top wall 57 formed at an upper end of the lip-like portion 55 of the cover member 37. The top wall 57 of the lip-like portion 55 is in close contact with the closure portion 33 of the sliding door 21. The top wall 57 of the lip-like portion 55 closes the upper end of the vertical space 59 and, hence, the sliding door 21 as a whole is improved in appearance. The vertical space 59 which is open at its lower end can serve as a water drainage passage.

The cover member 37 has a first orientation part 63 for confirming a vertical alignment between the through-hole 54 and the striker 22, and a second orientation part 64*a*, 64*b* for confirming a lateral alignment between the through-hole 54 and the striker 22. With the orientation parts 63, 64*a*, 64*b* thus provided, it is readily possible to adjust the assembling accuracy of the sliding door 21 and the vehicle body 11. The first orientation part 63 extends along a peripheral edge of the through-hole 54 and is thin and elastically deformable. The elastically deformable first orientation part 63 can be located as close to the striker 22 as possible.

The cover member 37 has an abutment rib 61, 62 projecting toward the striker 22 for undergoing abutting engagement with a base portion 23 of the striker 22. By thus providing the abutment rib 61, 62, it is possible to keep the engagement between the striker 22 and the lock device 36 in a stable condition.

The cover member 37 has a single-piece molded structure composed of a first piece 51 of rigid plastic and a second piece 52 of flexible plastic that are integrally molded with each other. A part of the harness-accommodating groove 56 including one end facing the anti-pinch sensor 42 is formed in the second piece 52, and the remaining part of the harness-accommodating groove 56 is formed in the first piece 51. By thus forming the end portion of the harness-accommodating groove 56 by the flexible plastic, it is possible to protect the sensor harness portion 43*a* from damage. The first piece 51 has a first color and the second piece 52 has a second color which is different from the first color of the first piece 51. By thus differentiate the color of the first and second pieces 51, 52, the physical characteristics of the two pieces 51, 52 of the cover member 37 can be visually confirmed.

Obviously, various minor changes and modifications of the present invention are possible in light of the above teaching. It is therefore to be understood that within the scope of the appended claims the invention may be practiced otherwise than as specifically described.

What is claimed is:

1. A vehicular sliding door structure, comprising:

a sliding door slidably mounted on a vehicle body for opening and closing a door opening defined in the vehicle body, the sliding door having a closure portion configured to undergo abutting engagement with a mating portion of the vehicle body, wherein the closure portion of the sliding door includes an end surface facing the mating portion of the vehicle body;

a lock device disposed in the closure portion of the sliding door for locking the sliding door relative to the vehicle body;

an anti-pinch sensor disposed on the closure portion of the sliding door for detecting an obstacle in a path of movement of the sliding door to thereby prevent the obstacle from being pinched between the sliding door and the vehicle body;

a striker provided on the mating portion of the vehicle body for undergoing locking engagement with the lock device;

the closure portion of the sliding door having a striker opening that is formed in the end surface of the sliding door for allowing the entry of the striker therethrough into an internal space of the sliding door for locking engagement with the lock device;

the anti-pinch sensor having a sensor harness arranged to enter the internal space of the sliding door through the striker opening; and a single cover member attached to the end surface of the closure portion of the sliding door so as to be disposed between the end surface and the mating portion when the sliding door is in a closed position, wherein the cover member closes the striker opening and covers a portion of the sensor harness, the cover member having a through-hole for the passage therethrough of the striker.

2. The vehicular sliding door structure according to claim 1, wherein the cover member has a recessed harness-accommodating groove for receiving therein the portion of the sensor harness, the harness-accommodating groove has one end facing the anti-pinch sensor and an opposite end connected to the striker opening of the closure portion of the sliding door, and the harness-accommodating groove slopes upward from the one end toward the opposite end thereof.

3. The vehicular sliding door structure according to claim 1, wherein the cover member includes a cover body for covering the striker opening of the closure portion, and a lip-like portion projecting from an end of the cover body and extending to the anti-pinch sensor, the lip-like portion being configured to extend along a surface configuration of the sliding door and cover the portion of the sensor harness.

4. The vehicular sliding door structure according to claim 3, wherein the lip-like portion of the cover member and the closure portion of the sliding door define therebetween a vertical space, the vertical space being open at a lower end thereof and closed at an upper end thereof by a horizontal top wall formed at an upper end of the lip-like portion of the cover member, the top wall of the lip-like portion being in close contact with the closure portion of the sliding door.

5. The vehicular sliding door structure according to claim 1, wherein the cover member has a first orientation part for confirming a vertical alignment between the through-hole and the striker, and a second orientation part for confirming a lateral alignment between the through-hole and the striker.

6. The vehicular sliding door structure according to claim 5, wherein the first orientation part extends along a peripheral edge of the through-hole and is thin and elastically deformable.

7. The vehicular sliding door structure according to claim 1, wherein the cover member has an abutment rib projecting toward the striker for undergoing abutting engagement with a base portion of the striker.

8. The vehicular sliding door structure according to claim 2, where the cover member has a single-piece molded structure composed of a first piece of rigid plastic and a second piece of flexible plastic that are integrally molded with each other, wherein a part of the harness-accommodating groove including said one end thereof is formed in the second piece and the remaining part of the harness-accommodating groove is formed in the first piece.

9. The vehicular sliding door structure according to claim 8, wherein the first piece has a first color and the second piece has a second color different from the first color of the first piece.

* * * * *